United States Patent [19]

Zaldivar

[11] 4,176,842

[45] Dec. 4, 1979

[54] ROLLING BALL GAME

[76] Inventor: Alcibiades D. Zaldivar, 2974 SW. 23 St., Miami, Fla. 33145

[21] Appl. No.: 934,587

[22] Filed: Aug. 17, 1978

[51] Int. Cl.[2] ..... A63F 67/04; A63F 7/06

[52] U.S. Cl. ..... 273/85 R; 273/30; 273/31

[58] Field of Search ..... 273/85, 88–92, 273/29 A, 30, 31, 25

[56] References Cited

U.S. PATENT DOCUMENTS

| | | | |
|---|---|---|---|
| 782,182 | 2/1905 | Vickers | 273/85 H |
| 2,313,701 | 3/1943 | White | 273/30 |
| 3,596,908 | 8/1971 | Long | 273/85 C |
| 3,995,859 | 12/1976 | Goldfarb et al. | 273/85 B |

FOREIGN PATENT DOCUMENTS

| | | | |
|---|---|---|---|
| 1478055 | 9/1969 | Fed. Rep. of Germany | 273/30 |
| 914987 | 7/1946 | France | 273/85 R |
| 5861 | of 1902 | United Kingdom | 273/30 |
| 672296 | 5/1952 | United Kingdom | 273/85 F |

*Primary Examiner*—Paul E. Shapiro

[57] ABSTRACT

A rolling ball game which is composed of a flat surfaced playing board defining a field divided into two opposite courts by an upstanding, medially arranged net elevated above the playing surface slightly higher than the playing ball for playing a game which simulates tennis and wherein players standing on opposite sides of the net may roll the ball by hitting it with a bat underneath the net, and wherein hinged upstanding court walls are provided in perpendicular relation to the net with the result that, if the ball hits either of the side walls, the wall which is hit will tip over indicating that there is an out of bounds ball.

4 Claims, 5 Drawing Figures

ROLLING BALL GAME

FIELD OF THE INVENTION

This invention relates to a rolling ball game.

BACKGROUND OF THE INVENTION

In the past there have been many games simulating tennis. This invention is of such a game generally; and it provides an indoor simulated tennis game wherein a gameboard is provided which is spanned by a net elevated above the surface of the gameboard and which separates the board into two courts at the ends of which players stand and roll a ball over the surface and underneath the net using bats and wherein an out of bounds indicator means are provided in the form of upstanding, hingedly mounted walls so that, if a ball hits them, they will tip over indicating an out of bounds ball. The game is generally adapted for indoor use in playing an interesting game similar in some respects to tennis.

OBJECTS OF THE INVENTION

It is an object of this invention to provide an interesting and amusing recreational game which includes a gameboard for use in an indoor simulated tennis game wherein a playing field is provided and wall sections bound the sides of the field which wall sections are hingedly mounted so that when a ball strikes it, they fall over indicating an out of bounds ball and wherein a net spans the mid-zone of the gameboard perpendicularly to the sidewalls and under this net the ball is adapted to be rolled by a player standing at opposite ends of the board who hit it with bats, and which game is simple and inexpensive to manufacture, easily installed, and readily stored when not in use.

In accordance with these and other objects which will become apparent hereinafter, the instant invention will now be described with reference to the accompanying drawings in which:

DESCRIPTION OF THE PREFERRED EMBODIMENT

Figure 1:
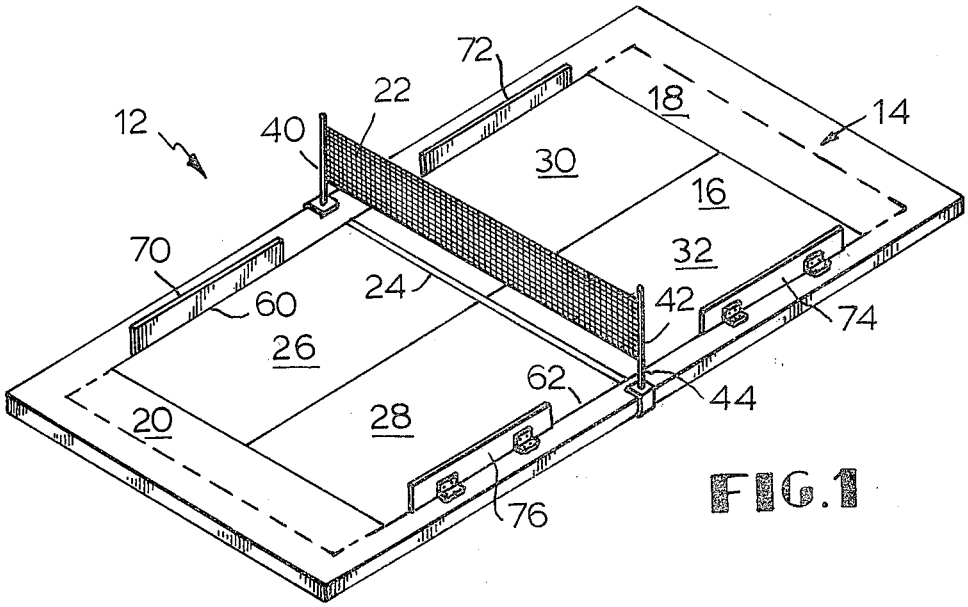
FIG. 1 is a perspective view of the game of the instant invention.
Figure 2:
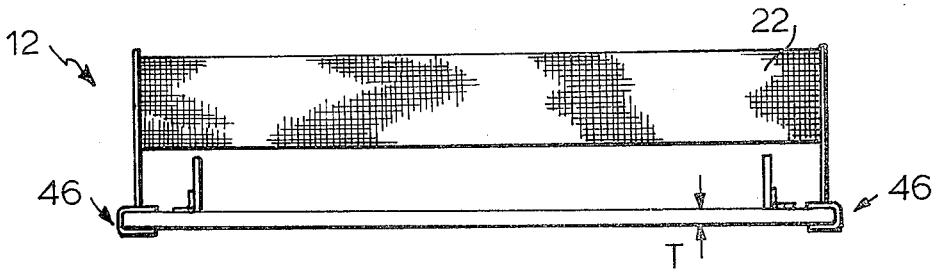
FIG. 2 is an end view in elevation.
Figure 3:
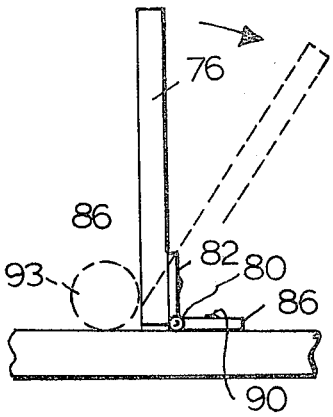
FIG. 3 is a partial view of the hinged wall connections shown in FIG. 1.
Figure 4:
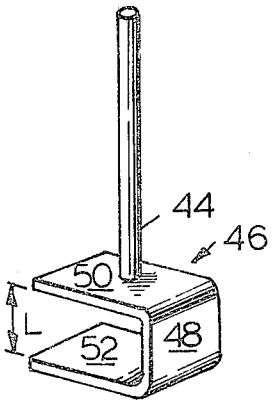
FIG. 4 is a view of a standard to support the net.

Referring to the drawings wherein like reference characters designate like or corresponding parts throughout the several views, the game is generally designated by the numeral 12. It is seen to include a flat rectangular playing board generally designated by the numeral 14 which has a smooth upper surface 16. The upper surface is divided by indicia into a playing field composed of two courts which may or may not have a serving zone at the opposite ends 18 and 20. A court is on each side of a net 22 medially arranged, as along the lateral line 24. Each court is separated into sections 26 and 28 and 30 and 32. The net 22 is supported by standards 40 and 42 having upper end zones to which the net is attached in spanning relation of the field. The lower ends of each standard, as at 44, see FIG. 4 are provided with a U bracket 46 having a base 48 and an upper flange 50 and a lower flange 52. The flanges 50 and 52 are spaced apart a distance L which is substantially equal to the thickness T of the gameboard, see FIG. 2, for nesting thereover as shown at the right of FIG. 2. Along the side boundary lines 60 and 62 of the playing surface, there are arranged four barrier walls 70, 72, 74 and 76, each of which is hingedly connected to the playing surface. With reference to FIG. 3, and particularly to the wall designated by the numeral 76, it is seen that each wall is hingedly connected to the gameboard as by the hinge 80 having an upper leaf 82 connected to the lower portion 84 of the wall and a second leaf 86 connected as by the screw means 90 to the gameboard. Each of the side walls is similarly connected to the gameboard and situated as shown.

Figure 5:
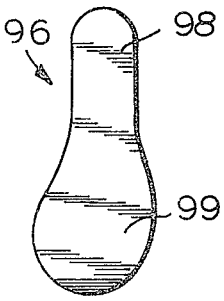
FIG. 5 is a view of a paddle for use in playing the game.

Referring to FIG. 5, the paddle designated by the numeral 96 is provided having a handle end 98 and a playing end 99. This paddle is preferably flat and generally planar resembling a ping pong racquet generally. It is for use in hitting a ball generally designated in FIG. 3 by the numeral 93.

In use, the flat rectangular surface is about 80 inches by 40 inches. The board is divided by mid-lines or two center lines defining courts. It is seen that on the board there is a rectangle printed which is about 60 inches by 34 inches and defines the game field. The longitudinal centerline divide the board into two opposite sides and is called the centerline. The lines of the rectangle parallel to the centerline are called the side lines. Also, the outermost lines parallel to the midcourt line are called the base lines. The six lines, the two base lines, two side lines, one mid-court line and one centerline form four rectangles 30 inches long by 17 inches wide. The strips of 10 inches between the base lines and the edges of the board are the batting zones. There may be lines drawn 5 inches from the edges called the batting lines. The net which is placed over the mid-court lines is 38 inches long by 6 inches wide. The bottom of the net is placed $1\frac{1}{4}$ times the diameter of the ball above the top surface of the board. The walls are $\frac{1}{2}$ inches thick and 18 inches long by 2 inches wide and are hingedly connected to the gameboard. The slats will fall whenever the ball touches them to indicate that the ball is an out of bounds ball and the loss of a point by the player who tipped over one of the walls. The ball is spherical and preferably about two and three quarters inches in diameter. Its size, weight and elasticity are similar to a tennis ball; and the bats are sized accordingly. The bat is preferably made of wood with rounded edges as shown in FIG. 5. Its shape is as shown; it is preferably about five-eighths of an inch thick and eleven inches long with the larger span of the head being about three and one-half inches and the span of the handle, which has rounded edges, is about one and five eighths inches.

In playing the game, a serving player bats the ball placed between the edge of the board and the innermost lateral line or batting line so that the ball will travel toward the diagonally opposite rectangles under the net without knocking over the slats or touching the net. While serving the ball, it can be held by the free hand, however, the ball must be batted and not pushed. The receiving player then bats the ball back when the ball has crossed his base line and not before. He can bat the ball to any of the two opposite rectangles. After the point is made, the serving player shall change and serve from the other side of the court and so on.

When the total number of points of both players add up to 5 or multiples of 5, the serving player shall receive and the receiving player shall serve. When the sum of the points of both players is an even number, the players will serve from the right-hand side of the court and when the number is odd, the serve will take place from the left-hand side.

A match is made up of the best of seven games of 20 points each. The player who reaches 20 points first wins the game and the player who wins 4 games wins the match. If the match cannot be completed due to circumstances beyond the control of the players, the winner will be the player ahead if at least 11 points of the four games have been played; if not, the match will be replayed at another time. After the second game of the match, the player that loses the game starts serving in the next game.

In playing the game, the following rules of scoring are applicable. A player loses a point when he serves without warning his opponent, he serves by batting the ball in movement, he bats the ball that has not crossed the base line, he bats the ball after it crossed the edge of the board, the ball touches the net or knocks over the side slats, he serves from the wrong side of the court, he touches the board with any part of his body while the ball is moving, he pushes the ball instead of batting it, and his bat crosses into the rectangles of the court.

Referring to the standards, the uprights may be one-sixteenth inch rods welded at the end of one of the flanges which extend about one inch on either side of the upright or two inches across. The flanges are spaced apart about one-half inch and sized to mate with the gameboard. The net is of any suitable material and is about six inches in height and its lower edge is about three and one-eighth inches above the playing surface.

What is claimed:

1. A simulated tennis game comprising a gameboard having a flat upper surface, indicia on said upper surface defining a playing field and separating said field into a first and a second court along a mid-court line and a net spanning said mid-court line above said playing field a first predetermined dimension and standards to support said net including means to connect to said gameboard and side boundary indicia for said courts and wall members vertically oriented along said side boundary indicia and hinge means to connect the wall members to said gameboard for swinging movement away from said courts and a playing ball of spherical form of a diameter less than said predetermined distance.

2. The device as set forth in claim 1 wherein said means for connecting said net supports comprises U-shaped members adapted to engage the gameboard.

3. The device as set forth in claim 1 wherein said courts are separated by a longitudinal line into two zones and a batting zone is defined for each court.

4. The device as set forth in claim 1 wherein said wall means are connected by hinge means to said gameboard.

* * * * *